US006089491A

United States Patent [19]

Plath

[11] Patent Number: 6,089,491

[45] Date of Patent: Jul. 18, 2000

[54] YARN DELIVERY DEVICE AND DRIVE WHEEL SUITABLE FOR THIS PURPOSE

[75] Inventor: Ernst-Dieter Plath, Albstadt, Germany

[73] Assignee: Sipra Patententwicklungs - U. Beteiligungsgesellschaft mbH, Albstadt, Germany

[21] Appl. No.: 09/126,201

[22] Filed: Jul. 30, 1998

[30] Foreign Application Priority Data

Aug. 1, 1997 [DE] Germany ..... 197 33 264

[51] Int. Cl.[7] ..... B65H 51/20

[52] U.S. Cl. ..... 242/366.4; 66/168

[58] Field of Search ..... 242/366.4, 364.6, 242/364.9, 365.8, 366.2; 66/168; 474/92, 93

[56] References Cited

U.S. PATENT DOCUMENTS

| | | | |
|---|---|---|---|
| 4,175,796 | 11/1979 | Boggs et al. | 474/92 X |
| 4,308,019 | 12/1981 | Horkey et al. | 474/92 X |
| 4,691,536 | 9/1987 | Yorisue et al. | 66/168 |
| 4,691,873 | 9/1987 | Gutschmit . | |
| 4,759,393 | 7/1988 | Kato et al. | 242/366.4 X |
| 4,890,464 | 1/1990 | Tsuchiya et al. | 242/366.4 X |
| 5,313,689 | 5/1994 | Oexler | 474/92 X |
| 5,408,851 | 4/1995 | Tsuchiya | 66/168 |
| 5,490,814 | 2/1996 | Whitenight | 474/92 |
| 5,564,291 | 10/1996 | Tsai | 66/168 |

FOREIGN PATENT DOCUMENTS

| | | |
|---|---|---|
| 0 185 131 B1 | 6/1986 | European Pat. Off. . |
| 0 217 373 B1 | 4/1987 | European Pat. Off. . |
| 0 271 373 A2 | 11/1987 | European Pat. Off. . |
| 0 499 218 B1 | 8/1992 | European Pat. Off. . |
| 2 283 971 | 4/1976 | France . |
| 37 11 558 C1 | 6/1988 | Germany . |
| 2 254 662A | 10/1992 | United Kingdom . |

*Primary Examiner*—Donald P. Walsh
*Assistant Examiner*—Minh-Chau Pham
*Attorney, Agent, or Firm*—Michael J. Striker

[57] ABSTRACT

A yarn delivery device has a casing, a delivery drum rotatably mounted on the casing, a drive belt, at least one drive wheel propelling the delivery drum, the drive wheel having a peripheral section for application of the drive belt and being provided with at least one cleaning channel extending in a peripheral direction, and at least one scrapper attached to the casing and projecting at a point of a peripheral section remaining free of the drive belt into the cleaning channel.

10 Claims, 2 Drawing Sheets

YARN DELIVERY DEVICE AND DRIVE WHEEL SUITABLE FOR THIS PURPOSE

BACKGROUND OF THE INVENTION

The invention relates to a yarn delivery device having a casing, a delivery drum rotatably mounted thereon, and at least one drive wheel intended to propel the delivery drum, said drive wheel having a peripheral section intended for application of a drive belt.

In known yarn delivery devices or feed mechanisms of this type (EP 0 217 373 A2), which are used in particular in numerous textile machines, the yarn delivery drum is usually propelled by means of a drive wheel which is designed in the form of a toothed belt disc or of a spur pinion, and is looped around on a portion of its circumference by a drive belt in the form of a toothed belt, which is driven from a central drive system. The toothing serves the purpose of avoiding slippage between the drive belt and the drive wheel, and in particular in the case of positive yarn supply to the textile machine, to ensure that at every point in time quantities of yarn are provided which are in a precisely defined ratio to the operating speed of the textile machine, e.g. to the rotary speed of the needle cylinder of a circular knitting machine.

When processing yarns in the form of fibre yarns, large amounts of floating fluff particles result in the atmosphere surrounding the textile machine. These among other things are caught up by the drive belt and carried along. Therefore it is conventional to provide at any point in the drive a cleaning device, in order to clean the drive belt and free it from the entrained fluff particles. Such cleaning devices for example contain two brush wheels rolling along the drive belt.

Cleaning devices of this sort have proved inadequate. Therefore, despite their use, fluff residues adhering to the drive belt are conveyed into the tooth gaps of the tooth belt discs, and in particular into the interspaces between the tooth points of the toothed belt, and are pressed into the base of the teeth of the toothed belt disc. The tooth spaces in this way are gradually and progressively filled, until their overfilling leads to a situation in which the toothed belt is pushed out of the tooth gaps, and proper propulsion is no longer possible, or the compressed fluff particles are released in an uncontrolled manner from the belt disc and drop off in the form of thick fluff clots. These are in addition frequently mixed with abrasions from the drive belt and/or the drive wheel, and mixed with oil, thereby becoming contaminated and also in addition extremely discoloured, and in particular can adopt a pitch-black colour.

As the yarn delivery devices in textile machines are frequently disposed directly above those working points at which the yarns supplied thereby are processed, there is a risk that the fluff clots will be processed together with the yarns by the textile machine. In the case of circular knitting machines, for example, the fluff clots could in this way pass into the area of influence of the knitting needles, and either destroy these or be worked into the knitted fabric to be produced by the circular knitting machine, which in this way is likewise contaminated and discoloured and thus require expensive subsequent treatment.

Corresponding problems can arise if instead of tooth belts and tooth belt discs, other propulsion means, particularly untoothed drive belts and drive rollers are used.

SUMMARY OF THE INVENTION

It is, therefore, an object of this invention to design the yarn delivery device described above in such a way that an accumulation of fluff particles on the drive belt and/or on the circumferential section of the drive wheel co-operating therewith is to a large extent avoided.

A further object of this invention is to design a drive wheel for the yarn delivery device mentioned above in such a way that an accumulation of fluff particles on the drive belt and/or the drive wheel can be avoided in a simple manner.

These and other objects of the present invention are solved in that the peripheral section of the drive wheel is provided with at least one cleaning channel surrounding in the peripheral direction, and there is attached to the casing at least one scraper, which projects at a point of the peripheral section remaining free of the drive belt with a free end section into the cleaning channel.

The invention further provides a drive wheel for a yarn delivery drum with at least one peripheral section intended for application of a drive belt, said drive wheel having a peripheral section which is provided with at least one cleaning channel rotating in the peripheral direction.

BRIEF DESCRIPTION OF THE DRAWINGS

The invention will be explained in more detail in the following in conjunction with the annexed drawings with reference to an embodiment given by way of example. Shown are.

DESCRIPTION OF PREFERRED EMBODIMENTS

Figure 1:
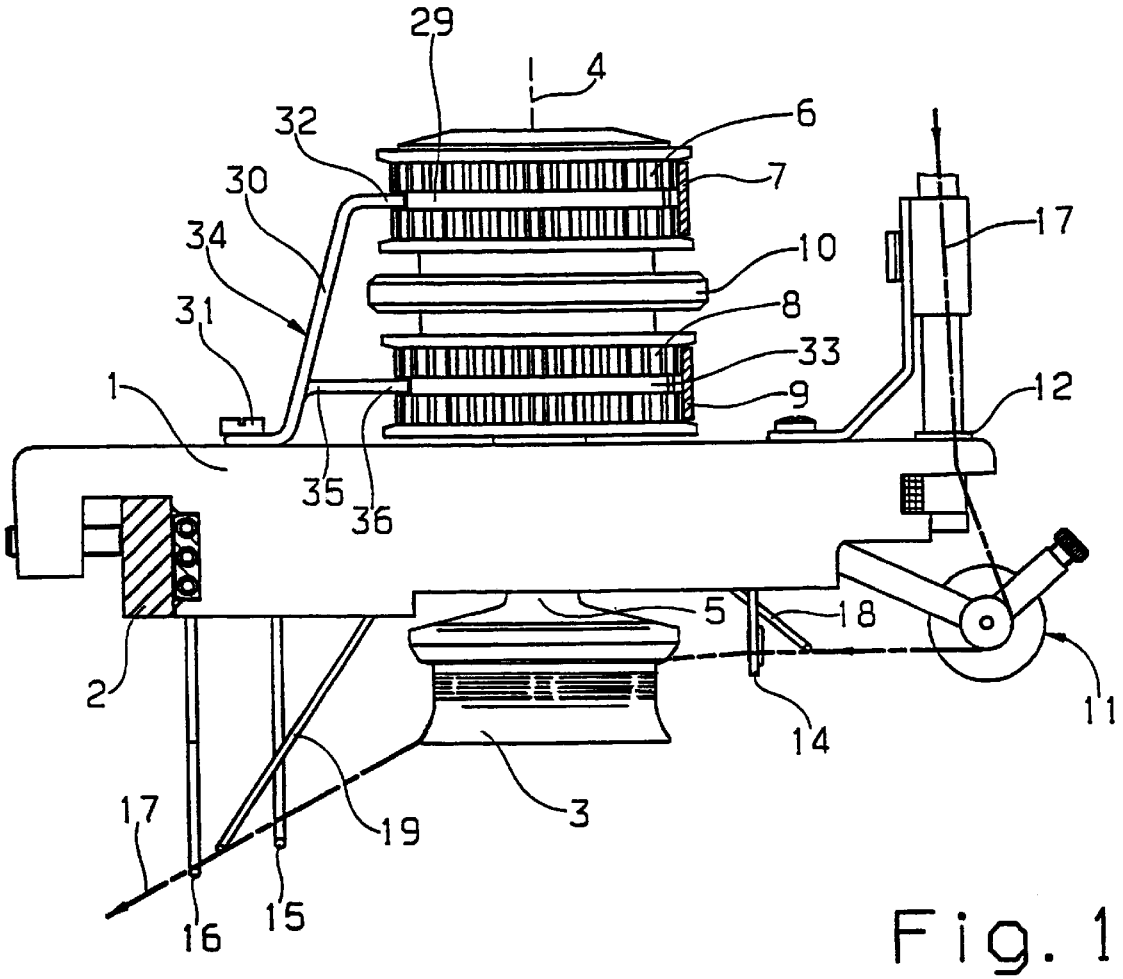
FIG. 1: a schematic side view of a yarn delivery device according to the invention.

The yarn delivery device shown in FIG. 1 has a casing 1, which is detachably secured on a sub-base 2 of a machine processing or consuming yarns, e.g. a circular knitting machine. Disposed on the underside of the casing 1 is a conventional storage or delivery drum 3, which is mounted to rotate about an axis of rotation 4 and for this purpose is rigidly connected to a shaft 5 rotatably mounted in the casing 1. Rotatably mounted on a portion of the shaft 5 projecting above the upper side of the casing 1 is a drive wheel 6, which is driven by a drive system not shown by means of a drive belt 7.

In order that the delivery drum 3 can be optionally propelled at different rotary speeds, frequently at least one further drive wheel 8 is secured coaxially on the shaft 5, and which is in an effective connection with a second drive belt 9. An e.g. manually switchable clutch disc 10 is non-rotarily connected to the shaft 5 between the two drive belts 6 and 8, and which can be displaced axially on the shaft 5 and thus can be non-rotarily coupled optionally, e.g. by frictional connection, with one or the other drive wheel 6 or 8. Thus either the drive wheels 6,8 have different diameters, or the drive belts 7,9 are driven at differing speeds.

Secured at the free end of the casing 1 are a yarn brake 11 and a yarn eye 12 located thereabove. On the underside of the casing 1 there is provided a yarn inlet guide member 14, e.g. an eye disposed between the yarn brake 11 and the delivery drum 3, while on the side of the delivery drum 3 lying diametrically opposite the guide member 14 are provided two yarn outlet members 15 and 16 secured to the underside of the casing 1, and which, like the guide member 14, can consist of open or closed eyes. A yarn 17 is passed from a supply spool not shown through the yarn eye 12, the yarn brake 11 and the guide member 14 obliquely from above and substantially tangentially onto the yarn support surface of the delivery drum 3, is wound up thereon in at least one, preferably a plurality of windings and finally is fed substantially tangentially through the two guide members 15 and 16 and a processing point not shown of a knitting machine or the like. Sensors 18 and 19, likewise attached to the casing 1, can in a conventional way serve to monitor the yarn 17.

Figure 2:
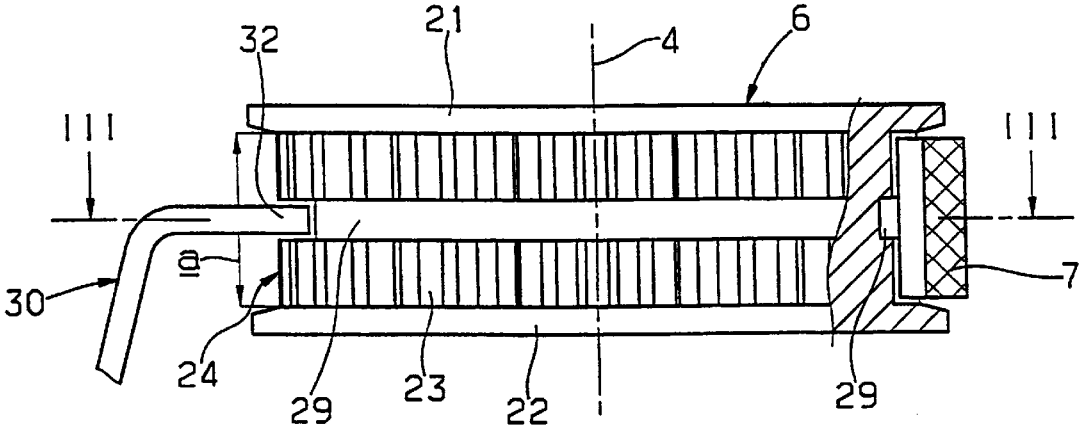
FIG. 2: a partially sectioned side view of a drive wheel according to the invention in a view enlarged in comparison to that in FIG. 1.
Figure 3:
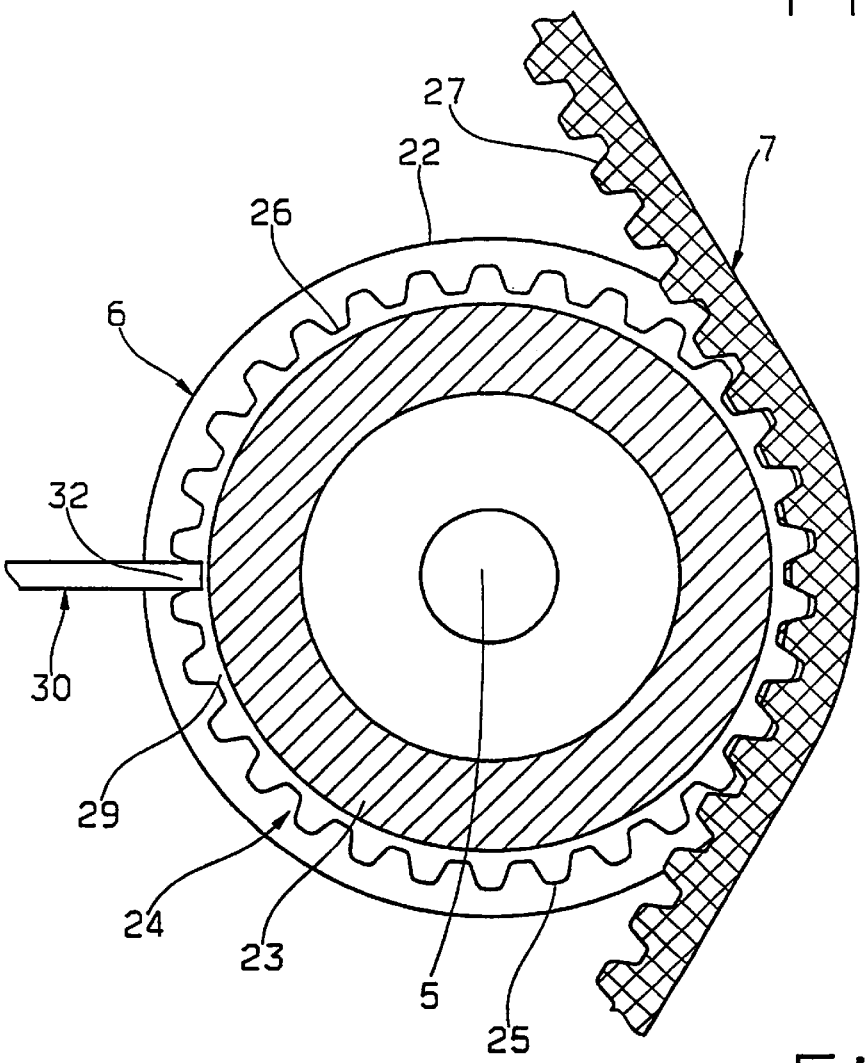
FIG. 3: a cross-section along line III—III of FIG. 2.

FIGS. 2 and 3 show on an enlarged scale the drive wheel 6 and the drive belt 7 of the yarn delivery device according to FIG. 1. The drive wheel 8 and the drive belt 9 can be substantially identical in design.

The drive wheel 6 has, for example in the fashion of a conventional drive belt, two spaced-apart and coaxially disposed substantially plane parallel circular flanged wheels 21 and 22, between which there sits a hollow cylindrical member 23 slightly smaller in diameter and secured to the shaft 5, and which forms a peripheral section 24 intended for application of the drive belt 7. This peripheral section 24 is provided with a toothing, which consists of teeth 25 extending parallel to the axis 4 and, disposed therebetween, tooth gaps 26, and serves to co-operate with or be brought into engagement with a corresponding toothing 27 of the drive belt 7 designed as a toothed belt, in order to ensure slip-free propulsion of the drive roller 6 by the drive belt 7. Thus the peripheral section 24 and the drive belt 7 can have a width substantially corresponding to the spacing between the flanged wheels 21,22, as shown in FIG. 2 by the measurement a.

Yarn delivery devices, drive wheels and drive belts of the type described are generally known to the person skilled in the art (e.g. DE 37 11 558 C1, EP 0 217 373 A2, EP 0 499 218 A1) and therefore need no further explanation.

According to the invention the drive roller 6 has a cleaning channel 29, which is machined in the peripheral section 24, extends over its entire circumference and is preferably disposed in the centre between the two flanged wheels 21,22.

According to the invention, there is associated with the cleaning channel 29 a scraper 30, which is secured by means of a screw 31 or the like (FIG. 1) to the casing 1, and e.g. consists of a rod-shaped component having a circular cross-section, which projects with one free end section 32 into the cleaning channel 29, appropriately without touching it, and preferably terminating close above its base. Thus it is evident that the drive belt 7, as FIG. 3 shows, always abuts on a portion of the peripheral section 24 of the drive wheel 6, and the scraper 30 projects at a point not occupied by the drive belt 7, e.g. at a point of the peripheral section 24 lying diametrically opposite the drive belt 7, into the cleaning channel 29.

The cleaning channel 29 is machined for example by a simple milling procedure into the peripheral section 24, where the complete drive wheel 6 is not manufactured as a plastics injection moulded part. The depth of the cleaning channel 29, measured in the radial direction of the peripheral section 24, starting from the outer surface of the peripheral section 24, is preferably slightly deeper than corresponds to the bases of the tooth gaps 26 of its toothing, and the scraper 30 preferably projects to such a depth into the cleaning channel 29 at the free end section 32 according to FIG. 3 likewise terminates beneath the bases of the tooth gaps 26.

The scraper 30 serves the purpose of removing all fluff particles, yarn residues and such contamination pressed into the tooth gaps 26 of the peripheral section 24, immediately from the tooth gaps 26 again, before they can be compressed into dense, possibly discoloured fluff clots. As the fluff and yarn portions are to a large extent disposed in the peripheral section 24 so that they are disposed at least partly parallel to the axis 4, they are reliably picked up by the scraper 30 and due to the movement of the drive wheel 6 taking place during operation of the yarn delivery device, and of the entailed air movement, are removed out of the area of the peripheral section 24, before any portion of the peripheral section 24 momentarily located in the area of the scraper 30 again passes into the area of influence of the drive belt 7. It is naturally also alternatively possible to provide respectively a plurality of cleaning channels 29 between the flanged wheels 21,22, and to associate with each cleaning channel a corresponding scraper 30, in order also reliably to pick up yarn residues or the like not extending over the width a.

The shape of the end section 32 of the scraper 30 is to a large extent optional. For example, the end section 32 of the scraper 30, deviating from FIG. 3, could also stand obliquely instead of radially and vertically to the axis 4 of the drive wheel 6, and could be provided with a wedge-shaped bevelled point disposed in the cleaning channel 29.

The precise position, arrangement and shape of the scraper 30 can be easily determined in individual cases by tests. The same applies to the width and depth of the cleaning channel 29. For this latter, a width of about 3 mm with a measurement a of e.g. about 13 mm and such a depth have proved easily useable, that the cleaning channel 29 projects over the bases of the tooth gaps 26 radially inwards by for example about 1 mm.

If according to FIG. 1 a plurality of drive wheels 6,8 are provided per delivery drum 3, these appropriately each have a cleaning channel 29,33, and with these there can be associated individual further scrapers attached to the casing 1. Alternatively it is however also possible, as FIG. 1 shows, to provide a component 34 common to all drive wheels 6,8, upon which a plurality of scrapers 30,35 with end sections 32,36 are integrally attached, each of which projects into an associated cleaning channel 29 or 33.

The scrapers 30,35 can be made from various materials, particularly metals (e.g. spring wire) or plastic, and can be designed extensively rigidly, but also flexibly, in dependence on the requirements of the individual case. In both cases the scraper 30,35 can consist of a tube, and can be designed at its free end as a blower nozzle, in order to connect it to a compressed air source or the like and thus to increase the cleaning action.

The invention is not restricted to the embodiment described, which can be varied in many ways. For example it is possible to attach the scraper 30 or the component 34, instead of to the casing 1, to another portion of the yarn delivery device or textile machine which is stationary with respect to the drive wheel 6,8. The term "casing" is therefore intended to comprise all these types of attachment. Furthermore, the drive belt 7,9 can be designed differently from the way shown and described, and in particular can have no peripheral toothing. In this case, the peripheral section 24 of the drive wheel 6,8 can also be smooth and without toothing, while the cleaning channels 29,33 project to a pre-selected depth into the peripheral section 24. Moreover, drive belts can be provided which are additionally or exclusively provided with toothings in at least one of their lateral edges, these toothings being in engagement with corresponding lateral toothings in the drive wheel (e.g. EP 0

185 131 B1). In these cases also the formation of fluff clots in the peripheral section 24 is reliably avoided. It would furthermore be possible to allow the free end sections 32,36 or other sections of the scrapers 30,35 to slide on the base of the cleaning channels 29,33, in order in this way also reliably to eliminate the formation of contamination in the cleaning channel 29,33, particularly when the scrapers 30,35 are made of a sufficiently flexible material. With respect to the indicated measurements for the width and depth of the cleaning channel 29, other values held to be appropriate can be used. It can be quite generally ascertained that the width of the cleaning channel 23 should for example be between one quarter and two thirds the value a and its depth should be at least about 0.5 to 1 mm deeper than the tooth base. Thus the scraper 30,35 can for example extend at least about 0.5 mm into the cleaning groove 29, and e.g. have a cross-sectional dimension which is about 1 mm smaller than the width of the cleaning channel, should it not be intended to touch the channel walls. Further, the invention is not restricted to drive wheels 6,8 which sit directly on the shaft 5 of the delivery drum 3. Alternatively, there could be drive wheels 6 or 8 physically separated from the delivery drum 3, which are coupled via further drive means in a drive relationship with the delivery drum 3. Finally it is evident that the features according to the invention can also be used in combinations different from those illustrated and described.

It will be understood that each of the elements described above, or two or more together, may also find a useful application in other types of constructions differing from the types described above.

While the invention has been illustrated and described as embodied in a yarn delivery device and a drive wheel therefor, it is not intended to be limited to the details shown, since various modifications and structural changes may be made without departing in any way from the spirit of the present invention.

Without further analyses, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A yarn delivery device, comprising a casing; a delivery drum rotatably mounted on said casing; a drive belt; at least one drive wheel propelling said delivery drum, said drive wheel having a peripheral section for application of said drive belt and being provided with at least one cleaning channel extending in a peripheral direction; and at least one scraper attached to said casing and projecting at a point of a peripheral section remaining free of said drive belt into said cleaning channel.

2. A yarn delivery device as defined in claim 1; and further comprising at least one further drive wheel having a peripheral section provided with at least one further cleaning channel; and a further scraper projecting into said further cleaning channel, each of said scrapers being secured to said casing and projecting into a respective one of said cleaning channels.

3. A yarn delivery device as defined in claim 1, wherein said cleaning channel is located substantially in a center of said peripheral section.

4. A yarn delivery device as defined in claim 1, wherein said drive belt is a toothed belt, said peripheral section being provided with a toothing corresponding to a toothing of said toothed belt.

5. A yarn delivery device as defined in claim 1, wherein said scraper is composed of a tube.

6. A yarn delivery device as defined in claim 1, wherein said scraper has an end projecting into said cleaning channel and formed as a blower nozzle.

7. A yarn delivery device as defined in claim 1, wherein said scraper has an end section projecting into said cleaning channel.

8. A drive wheel of a yarn delivery drum, the drive wheel comprising at least one peripheral section for application of a drive belt, said peripheral section being provided with at least one cleaning channel for receiving a scraper, said cleaning channel extending in a peripheral direction and being radially outwardly open.

9. A yarn drive wheel as defined in claim 8, wherein said cleaning channel is located substantially in a center of said peripheral section.

10. A drive wheel as defined in claim 8, wherein said peripheral section is provided with a toothing forming tooth gaps with bases and wherein said cleaning channel projects a toothing forming tooth gaps with bases and wherein said cleaning channel projects deeper into said peripheral section as corresponds to said bases.

* * * * *